US006129159A

United States Patent [19]

Scott et al.

[11] Patent Number: 6,129,159

[45] Date of Patent: Oct. 10, 2000

[54] VIBRATORY DRILL HEAD APPARATUS

[75] Inventors: Hugh J. Scott, Wellington; John A. Clarke, Picton, both of Canada

[73] Assignee: MPI Drilling, Picton

[21] Appl. No.: 09/220,370

[22] Filed: Dec. 24, 1998

[51] Int. Cl.[7] ..... E21B 7/24

[52] U.S. Cl. ..... 175/55; 173/49

[58] Field of Search ..... 175/55, 56, 20; 173/49

[56] References Cited

U.S. PATENT DOCUMENTS

| | | | |
|---|---|---|---|
| 3,004,389 | 10/1961 | Muller | 175/56 |
| 3,368,632 | 2/1968 | Lebelle | 173/49 |
| 3,379,263 | 4/1968 | Bodine | 175/55 |
| 3,583,497 | 6/1971 | Kossowski | 173/49 |
| 4,113,034 | 9/1978 | Carlson | 173/49 |
| 4,625,811 | 12/1986 | Tuenkers | 173/49 |
| 5,004,055 | 4/1991 | Porritt et al. . | |
| 5,058,688 | 10/1991 | Scott et al. . | |
| 5,417,290 | 5/1995 | Barrow . | |

*Primary Examiner*—Brian L. Johnson
*Assistant Examiner*—Joselynn Sliteris
*Attorney, Agent, or Firm*—Bereskin & Parr

[57] ABSTRACT

A vibratory drill head for use with a drill stand apparatus. The eccentric cams are mounted on parallel drive shafts which are powered by hydraulic motors. The hydraulic motors cause the drive shafts to spin in opposite directions. The counter-rotating eccentric cams eliminate horizontal vibration and maximize vertical vibration. The vibratory drill head is mounted to a drill shaft such as a sample tube. When the vibrating drill shaft is lowered into the soil, the vibrations allow the sample tube to pierce the soil to collect the sample. The minimization of horizontal vibration produces accurate core samples.

11 Claims, 6 Drawing Sheets

VIBRATORY DRILL HEAD APPARATUS

FIELD OF THE INVENTION

This invention relates to a drilling apparatus, and more particularly to mechanisms for vibrating drill shafts.

BACKGROUND OF THE INVENTION

There is a continuing need for apparatus for drilling holes into the ground. Holes are required for wells, and fence posts must be secured in the ground. Shafts are required for placing explosives deep into the ground for seismological testing purposes. Piles need to be driven into the ground for building various structures, and tubes must be placed in the ground to monitor groundwater. Large diameter soil samples are required for engineering, environmental, agricultural and mining purposes.

Drill stands have been used for many years for these purposes. Most drill stands use a rotational drilling technique to allow the drill shaft to penetrate the soil. However, in recent years vibratory drills have gained favour for many of these same applications.

The use of high frequency vibratory drills facilitates the collection of sediment cores with minimal disruption of the circumference layer and without serious compaction and dewatering of the sample. U.S. Pat. No. 5,004,055 to Porritt et. al. discloses a drill core apparatus comprising a sampler tube, a drill stand and a vibratory head for the sampler tube. The vibratory head comprises a pair of eccentric cams mounted on a shaft at a variable angle to one another within a housing. The drive is powered by a hydraulic drive motor. The amplitude of vibration is adjusted by changing the angle between the cams.

The above vibratory drill head above has proven to be very successful. However, in certain situations greater vibratory force is required than can be applied using this drill head. As well, with the greater vibratory force it is desirable that horizontal vibration be reduced.

SUMMARY OF THE INVENTION

The present invention is directed to a vibratory drill head for use with drilling apparatus including a drill stand and a drill shaft extending along a drilling axis. The vibratory drill head comprises a housing releasably coupled to the drill stand and the drill shaft, a pair of spaced drive shafts mounted within the housing, a pair of eccentric cams, each of which is rigidly mounted on one of the drive shafts, and motor means for counter-rotating the drive shafts at the same speed. The drive shafts are spaced apart and are mounted for rotation about parallel axes which are perpendicular to the drilling axis. When the shafts are rotated, the eccentric cams provide the vibratory drill head with a synchronized vibratory force along the drilling axis.

The eccentric cams are preferably a matched pair having the same size, shape and weight, which are mounted in an opposing fashion in a plane normal to the drive axes.

The vibratory drill head may contain two pairs of opposing eccentric cams, wherein two cams are mounted on each drive shaft and are longitudinally spaced from each other along the drive axes.

BRIEF DESCRIPTION OF THE DRAWINGS

For a better understanding of the present invention, and to show more clearly how it may be carried into effect, reference will now be made by way of example to the accompanying drawings, in which.

DETAILED DESCRIPTION OF THE PREFERRED EMBODIMENT(S)

Figure 1:
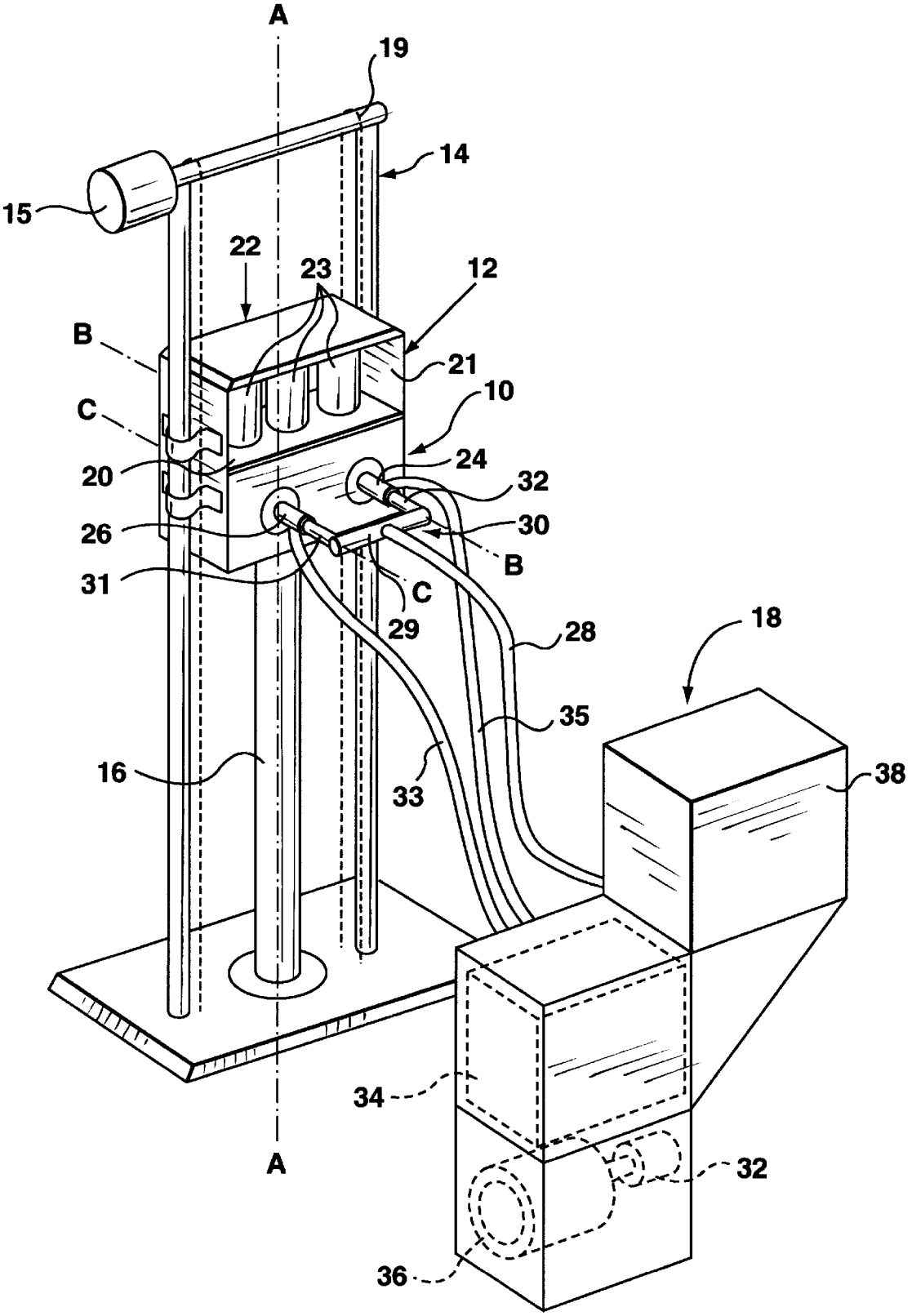
FIG. 1 is a perspective view of the drill apparatus in which the vibratory drill head of the present invention is housed.

Referring to FIG. 1, illustrated therein is vibratory drill head shown generally as 10, made in accordance with a preferred embodiment of the invention. Vibratory drill head 10 is shown mounted within carriage assembly 12 of drill stand 14. Vibratory drill head 10 is releasably coupled to the top of drill shaft 16, which is typically mounted with its longitudinal drilling axis A in the vertical direction for the purposes of drilling into the soil. Drill shaft 16 may be a solid drill string or it may comprise hollow tubes for collecting soil samples. Carriage drive 15 is operable to drive the carriage assembly 12 and drill shaft 16 along drilling axis A via chains 19. It should be understood that drill stand 14 is merely one type of drill stand, and that the subject vibratory drill head 10 can be used with various different types of drill stands.

As shown, carriage assembly 12 comprises carriage box 22 coupled to chains 19. Carriage box 22 is typically a metal box with the back wall removed having rubber-lined inner walls 21, and cavities in the front wall and in the bottom. Isolators 23 are placed in the space between the top of carriage box 22 and drill head 10. When so constructed, carriage box 22 serves to remove the vibration effects of drill head 10 on the rest of drill stand 14. It should be understood that carriage box 22 is an optional component of the drill stand 14 and other forms of drill stands may not require the use of same.

Vibratory drill head 10 comprises drill head housing 20 mounted within carriage box 22, and hydraulic motors 24 and 26 powered by a hydraulic pressure source 18. Hydraulic motors 24, 26 are preferably high speed gear motors, capable of spinning at a minimum 12,000 rpm (200 Hz).

Hydraulic pressure source 18 comprises a reservoir 34 for storing hydraulic fluid, a hydraulic pump 32 for pumping hydraulic fluid to a high pressure, a prime mover 36 for operating the hydraulic pump 32, and a control module 38 for regulating the hydraulic pressure supplied to hydraulic motors 24 and 26. A flexible hose (not pictured) transports hydraulic fluid to hydraulic pump 32. The hydraulic fluid is pressurized and transported via flexible hoses (not pictured) to control module 38.

The hydraulic fluid is then transported via flexible tubing 30 to hydraulic motors 24 and 26. The flow of the hydraulic fluid is split equally to hydraulic motors 24, 26 by connecting high pressure hose 28 to header 29 which is connected to supply tubes 31, 32, extending from motors 24, 26. Additional flexible hoses 33, 35 carry depressurized hydraulic fluid back to reservoir 34 from motors 24, 26.

Figure 2:
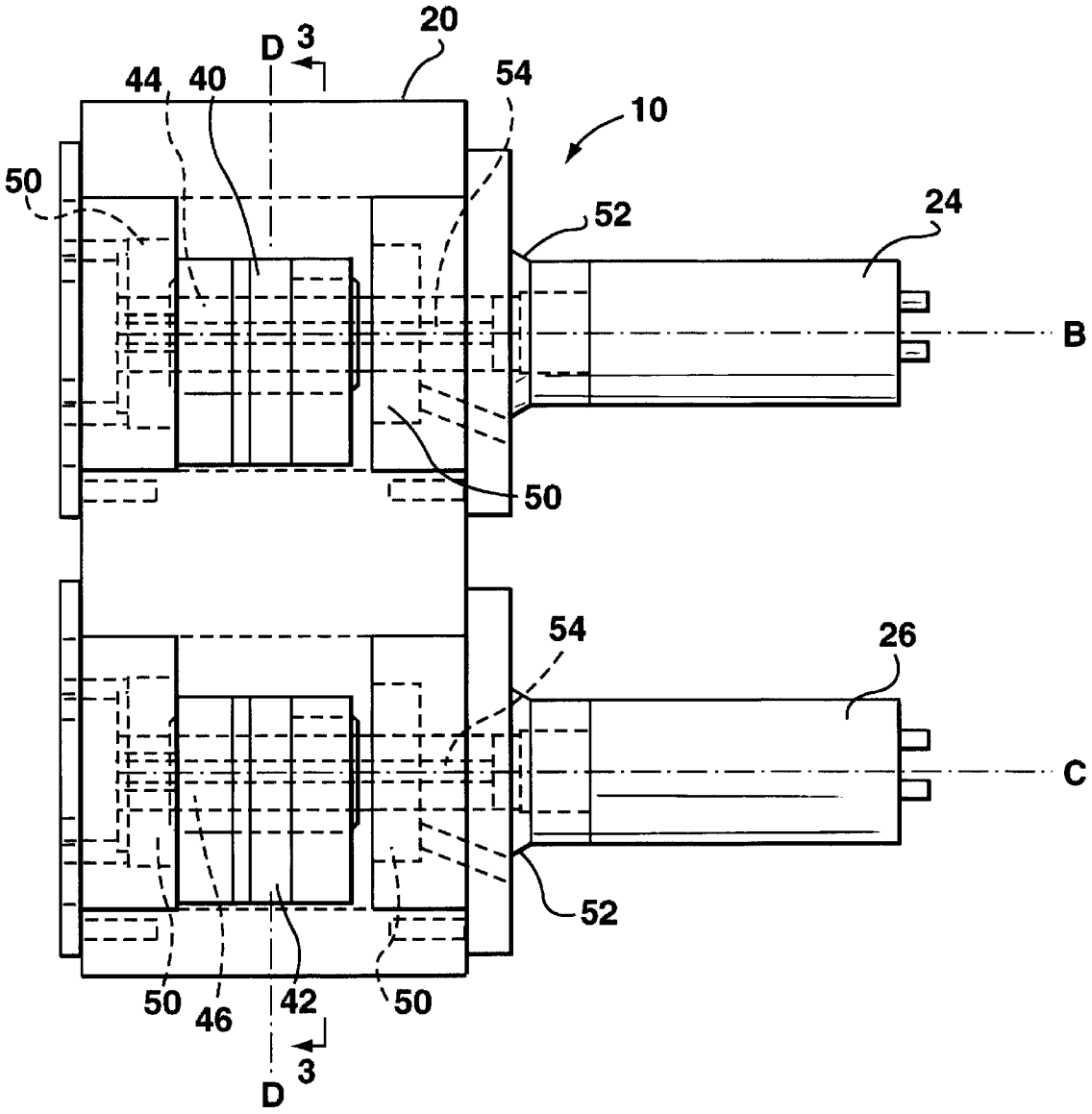
FIG. 2 is a top view of the vibratory drill head.

Referring now to FIG. 2, vibratory drill head 10 comprises a pair of eccentric cams 40 and 42 rigidly mounted on drive shafts 44 and 46 rotatably mounted within housing 20 on bearings 50. Drive shafts 44 and 46 are mounted along spaced, parallel drive axes B, C, which are normal to drilling axis A. Drive shafts 44 and 46 are spaced apart sufficiently to allow unimpeded rotation of eccentric cams 40 and 42. Eccentric cams 40 and 42 are preferably a matched pair having the same size, shape and weight. Cams 40 and 42 are preferably mounted on drive shafts 44, 46 in an opposing fashion in a common plane D normal to drive axes B, C.

Hydraulic motors 24 and 26 are mounted on housing 20 using motor mounts 52. Hydraulic motors 24 and 26 are connected to drive shafts 44 and 46 respectively using key stocks 54, and are set up to spin in opposite directions. The operation of hydraulic motors 24 and 26 causes the eccentric cams 40 and 42 to rotate in opposite directions, and thereby exert forces on housing 20 which cause drill head 10 to vibrate, in a manner hereinafter described.

Figure 3:
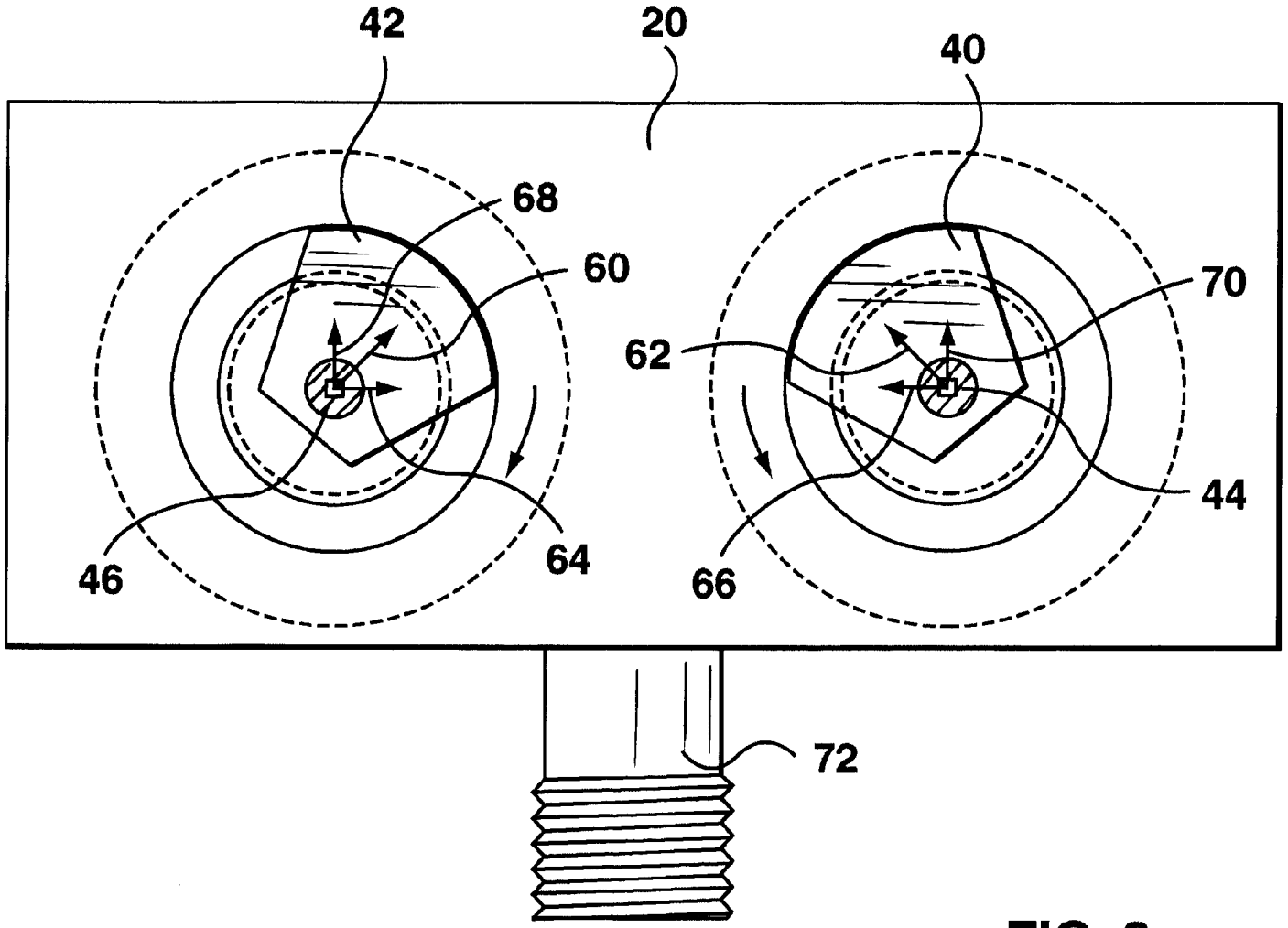
FIG. 3 is a sectional view along line 3—3 of FIG. 2 which shows the vibratory forces exerted by the eccentric cams of FIG. 2.

Referring mainly now to FIG. 3, the spinning of the eccentric cams exerts angular forces 60 and 62 on housing 20. Forces 60 and 62 can be resolved into horizontal force components 64 and 66 and vertical force components 68 and 70, respectively. The inventors have found that when drive shafts 44 and 46 spin at the same frequency, the weighted ends of eccentric cams 40 and 42 naturally tend to point in the vertical direction at the same time. As a result, the vertical force components 68, 70 are additive, whereas the horizontal force components 64 and 66 have equal magnitudes but point in opposite directions. Consequently, the net horizontal vibratory force exerted by the spinning of eccentric cams 40 and 42 is negligible, whereas the net vertical vibratory force is significant. When cams 40 and 42 are rotated in this manner they are said to be synchronized.

Figure 4:
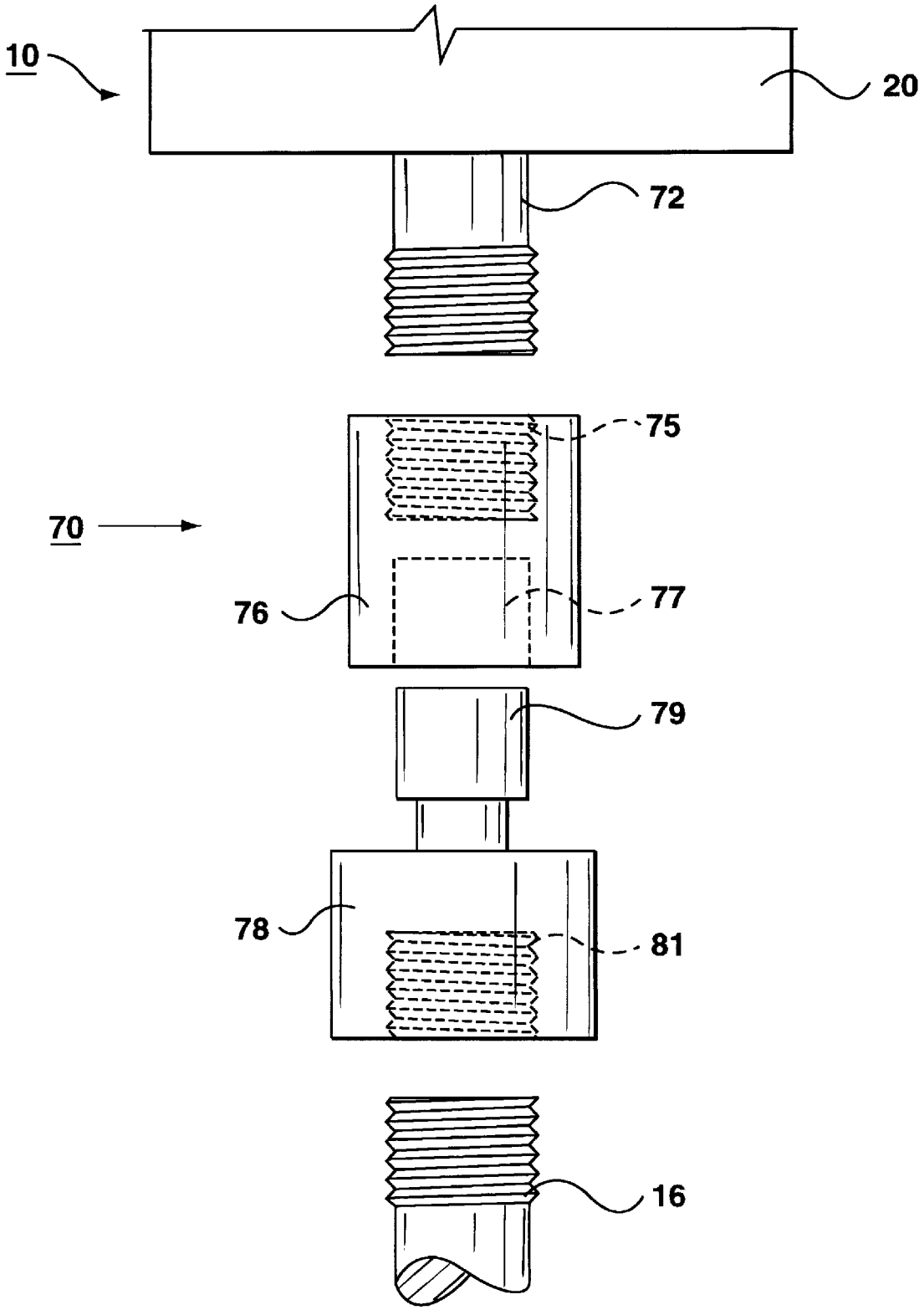
FIG. 4 is an exploded view of a coupler connecting the vibratory drill head and the drill shaft.

Referring now to FIG. 4, vibratory drill head 10 preferably includes drill shaft coupler shown generally as 70, for coupling drill shaft 16 to housing 20. Coupler 70 comprises threaded pipe 72 extending from the bottom of housing 20, and coupling members 76 and 78. Coupling member 76 has a threaded inner portion 75 at the top sized to receive threaded pipe 72. Coupling member 78 has a threaded inner portion 81 at the bottom sized to receive the threaded top portion of drill shaft 16, and an upwardly extending cylindrical head portion 79 shaped to slidably fit into socket 77 in the bottom of coupling member 76. When drill head 10 exerts a vibratory force in the downwards direction, the coupling member 76 exerts a force against head portion 79 of coupling member 78, which pushes drill shaft 16 into the ground. When the vibratory force is exerted in the upwards direction coupling member 76 slides upwardly, leaving coupling member 78 and drill shaft 16 in place. The amplitude of vibration is less than the distance that head portion 79 extends into socket 77, so that members 76, 78 do not decouple as drill head 10 vibrates. This connection method allows drill shaft 16 to be driven into the ground in an efficient fashion, as no upwards force is exerted on drill shaft 16 during operation of vibratory head 10.

The operation of the vibratory drill head 10 will now be described. Prime mover 36 is activated, and hydraulic pump 32 pressurizes a quantity of hydraulic fluid which makes its way to hydraulic motors 24 and 26. Control module 38 modulates the flow of pressurized hydraulic fluid to hydraulic motors 24 and 26. Drill shaft 16 is coupled to vibratory head 10 by coupler 70 while carriage assembly 12 is in its fully retracted position. Hydraulic motors 24, 26 are then activated, which cause drive shafts 44, 46 to spin in opposite directions. Because tubing 30 splits the flow evenly to supply hydraulic motors 24, 26, drive shafts 44, 46 along with eccentric cams 40, 42 will spin at the same frequency, preferably at approximately 200 Hz, but in opposite directions. As previously described, this will cause vibratory drill head 10 to vibrate in the vertical direction only.

Carriage drive means 15 is then activated to lower carriage assembly 12 with sufficient force so as to cause rapidly vibrating drill shaft 16 to penetrate the soil. Carriage assembly 12 is lowered until vibrating drill shaft 16 has penetrated the soil to the desired depth. Drill shaft 16 can be retracted by replacing coupler 70 with a conventional coupler having threads at both ends, and by activating carriage drive means 15 to raise carriage assembly 12.

Figure 5:
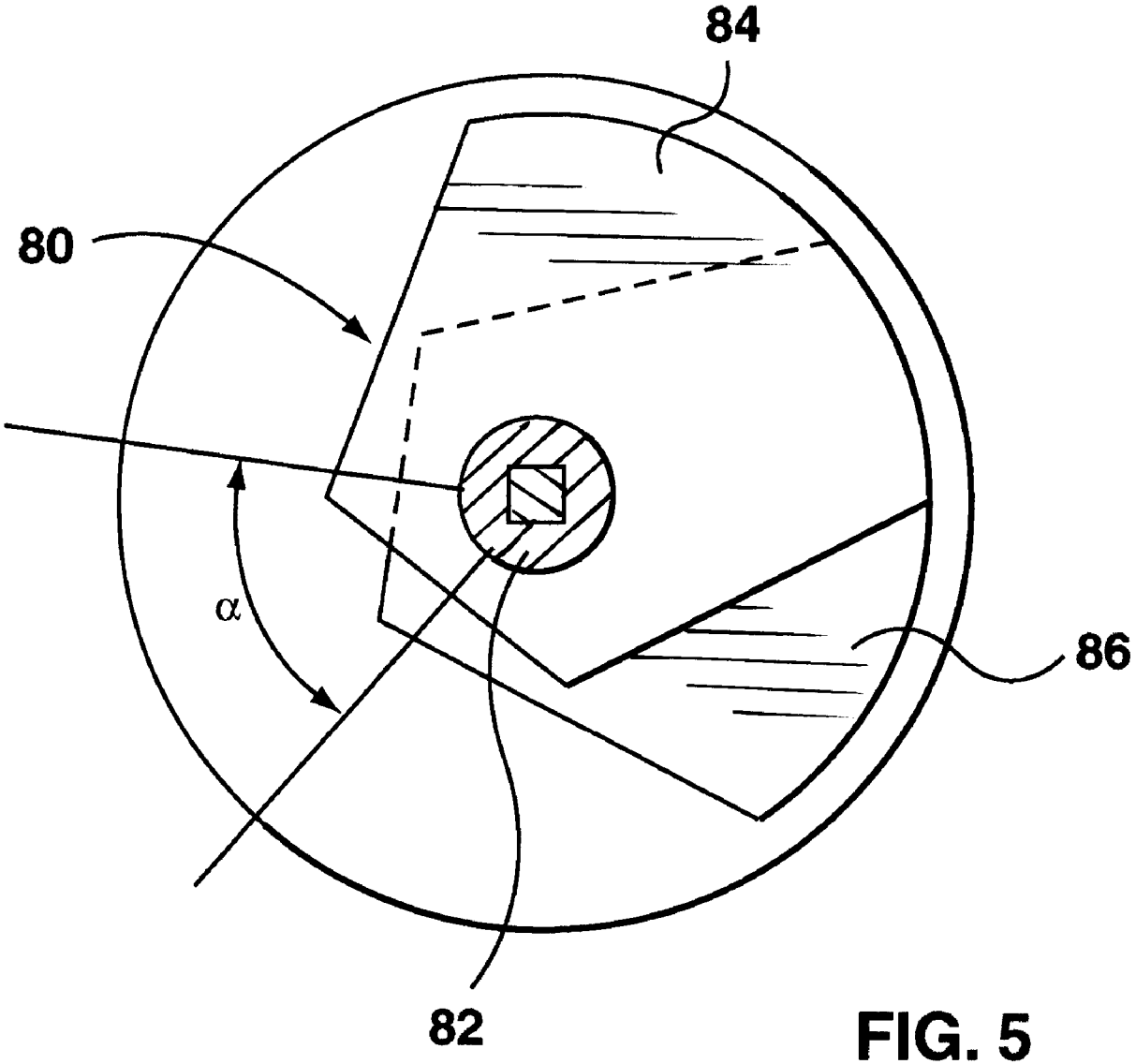
FIG. 5 is a cross sectional side view of a portion of an alternative embodiment of the invention having angularly adjustable eccentric cams.

Referring now to FIG. 5, in an alternative embodiment, each of cams 80 may optionally comprise a set of two angularly adjustable eccentric cam members 84 and 86 of different weight. Cam members 84, 86 are mounted adjacent each other on the same drive shaft 82 at an angle $\alpha$ to one another. The amplitude of the vibrations may be varied by changing the angle $\alpha$. When a equals 180°, the eccentric cams are counter-opposed and, therefore, the spinning of shaft 82 results in minimal amplitude of vibration. Maximal amplitude of vibration results from the lowering of the variable cam angle $\alpha$ to 0°. For the removal of horizontal vibrations, the two sets of cam members 84, 86 should have the same alpha value albeit measured in opposite direction. However, in some situations, such as drilling through clay, some horizontal vibration is desired in order to properly penetrate the ground. In these situations, the offset angle $\alpha$ of the one set of cams 84 and 86 will be set to a different value to the $\alpha$ value of the second set of cams 84 and 86. The horizontal forces will not be completely cancelled out as a result, thus allowing for better penetration of the drill shaft in certain types of soil.

Figure 6:
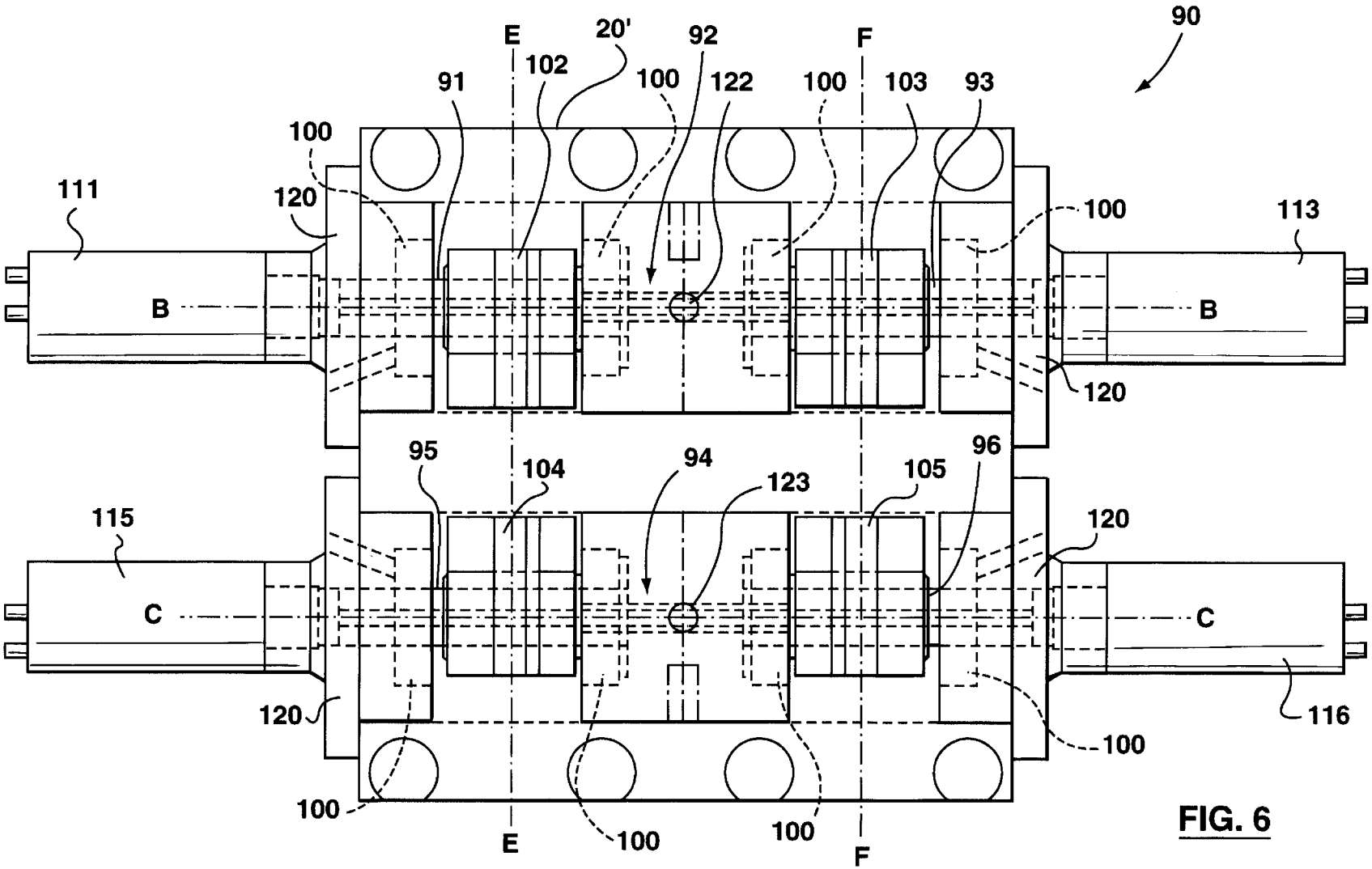
FIG. 6 is a top view of a further alternative embodiment of the subject invention having two opposing pairs of eccentric cams.

Referring now to FIG. 6, in an alternative embodiment, the subject invention comprises a quad drill head 90, having two pairs of opposing, counter-rotating eccentric cams. Quad drill head 90 comprises drive shaft 92 rotatably mounted on bearings 100 within housing 20' along drive axis B, and drive shaft 94 rotatably mounted on bearings 100 within housing 20' along drive axis C. Spaced eccentric cams 102, 103 are rigidly mounted on drive shaft 92, and spaced eccentric cams 104, 105 are rigidly mounted on drive shaft 94. Drive shaft 94 is parallel to and spaced from drive shaft 92 to allow for free rotation of eccentric cams 102–105. Eccentric cam 102 on shaft 92 and counter-rotating cam 104 on shaft 94 are in a common plane E normal to the drive axes. Cam 103 on shaft 92 and counter-rotating cam 105 on shaft 94 are located in a second common plane F parallel to common plane E.

Drive shaft 92 preferably comprises a pair of collinear drive shaft members 91, 93 rigidly coupled together with key stock 122, which results in shaft members 91, 93 rotating together in phase and at the same frequency. Likewise, drive shaft 94 preferably comprises a pair of drive shaft members 95, 96 coupled together by key stock 123. Drive shaft members 91, 93 are driven by hydraulic motors 111, 113, respectively, and drive shaft members 95, 96 are driven by hydraulic motors 115, 116, respectively. Key stocks 122, 123 loosely fit into cavities in shafts 92, 94, which allow the cams to be slightly out of phase at times, thereby preventing damage to hydraulic motors 111, 113, 115 and 116. Hydraulic motors 111, 113, 115 and 116 are attached to their respective drive shaft members 91, 93, 95 and 96 using engine mounts 120.

When the hydraulic motors are activated, drive shaft 92 and eccentric cams 102, 103, spin at the same frequency, but in the opposite direction as drive shaft 94 and eccentric cams 104 and 105. As a result, the horizontal components of force exerted by opposing pairs of counter-rotating cams 102, 104 and 103, 105 are out of phase and cancel, whereas the vertical components of force are in phase and add up. Thus, vibratory drill head 90 vibrates in the vertical direction only. The quad drill head can be used in situations which require greater drilling power.

The vibratory drill heads of the subject invention can be used in a multitude of applications. The high frequency coupled with the low amplitude of the vibrations allows for very fast penetration of almost any type of soil. Some applications require long and deep holes placed perpendicularly into the ground including drilling of wells, drilling of holes for seismological testing. With an appropriate drill shaft 16, the apparatus described herein would be suitable for such a function. The apparatus could also be used to drive many types of long thin objects such as piles into the ground. Provided appropriate coupling means were used to attach the objects to the vibratory drill head, the objects could serve as the drill shafts and the apparatus could serve to drive these objects into the ground. As well, groundwater monitoring could take place by driving measurement tubes designed for such purposes into the ground. A third application is soil sampling. Sample tubes would be used as the drill shaft in such an application.

The removal of vibration in the horizontal direction results in more accurate core samples as the sample tube does not vibrate against the walls of the drilled hole and results in less soil disturbance. Very accurate and representative core samples may be obtained by regulating the amplitude of vibration and the rate of sample tube penetration.

Finally, where an object has been placed into the soil and requires removal, the vibratory drill apparatus can be used for that removal. The object is first coupled to the vibratory drill head which is activated. The carriage drive slowly raises the object which shakes itself free from the soil as a result of the vibration of the vibratory drill head.

It should be understood that various changes may be made to the embodiments of the invention described herein without departing from the scope of the subject invention, which is defined in the following claims.

What is claimed is:

1. A vibratory drill head apparatus for use with drilling apparatus including a drill stand and a drill shaft, extending along a drilling axis, the vibratory drill head comprising:

(a) a housing releasably coupled to the drill stand and to the drill shaft;

(b) a pair of drive shafts mounted in the housing for rotation about spaced parallel drive axes perpendicular to the drilling axis;

(c) a pair of eccentric cams for exerting vibratory forces on the housing when the drive shafts are rotated, wherein each of the eccentric cams is rigidly mounted on one of the drive shafts, the drive shafts being spaced to allow for rotation of the cams;

(d) motor means for counter-rotating the drive shafts at the same speed, thereby synchronizing the vibratory forces generated by the eccentric cams along the drilling axis; and (e) coupling means for coupling the housing to the drill shaft, wherein the coupling means comprises a coupling member extending downwardly from the housing which slidingly fits over a coupling member extending upwardly from the drill shaft.

2. The apparatus defined in claim 1, wherein the eccentric cams comprise a matched pair of cams having the same size, shape and weight.

3. The apparatus defined in claim 2, wherein the eccentric cams are mounted in an opposing fashion on the drive shafts in a common plane normal to the drive axes.

4. The apparatus defined in claim 3, wherein the high pressure hoses comprise a hose extending from each motor coupled to a header connected to a common supply hose extending from the hydraulic pressure source.

5. The apparatus defined in claim 2, wherein the motors comprise hydraulic motors coupled to a common hydraulic pressure source by high pressure hoses.

6. The apparatus defined in claim 1, wherein the motor means comprises a pair of motors mounted on the housing, wherein each of the motors is operatively coupled to one of the drive shafts.

7. The apparatus defined in claim 1, wherein each eccentric cam comprises two angularly adjustable cam members mounted adjacent and at a variable angle to each other, the angle being adjustable so as to control the magnitude of the vibrations.

8. A vibratory drill head apparatus for use with a drill apparatus including a drill stand and a drill shaft extending along a drilling axis, the vibratory drill head comprising:

(a) a housing releasably coupled to the drill stand and to the drill shaft;

(b) a pair of drive shafts mounted in the housing for rotation about spaced parallel drive axes, wherein each of the drive shafts comprises a pair of co-linear drive shaft members coupled together;

(c) two matched pairs of opposing eccentric cams, wherein each of the eccentric cams is rigidly mounted on each of the drive shaft members; and (d) motor means for counter-rotating the drive shafts at the same speed, thereby synchronizing the forces generated by the eccentric cams along the drilling axis.

9. A vibratory drill head apparatus for use with drilling apparatus including a drill stand and a drill shaft, extending along a drilling axis, the vibratory drill head comprising:

(a) a housing releasably coupled to the drill stand and to the drill shaft;

(b) a pair of drive shafts mounted in the housing for rotation about spaced parallel drive axes perpendicular to the drilling axis, wherein each drive shaft comprises a pair of collinear drive shaft members, coupled together at the mid point of the drive shaft by a shaft coupler;

(c) two pairs of opposing eccentric cams for exerting vibratory forces on the housing when the drive shafts are rotated, wherein one of the eccentric cams is mounted on each of the drive shaft members; and (d) motor means for counter-rotating the drive shafts at the same speed, thereby synchronizing the vibratory forces generated by the eccentric cams along the drilling axis.

10. The apparatus defined in claim 9, wherein the shaft coupler comprises a section of key stock fitted into cavities in the ends of the shaft members.

11. The apparatus defined in claim 9, wherein the motor means comprise four hydraulic motors, each of the hydraulic motors being coupled to one of the drive shaft members.

* * * * *